US010163618B2

(12) United States Patent
Xiong et al.

(10) Patent No.: US 10,163,618 B2
(45) Date of Patent: Dec. 25, 2018

(54) MASS SPECTROMETRY APPARATUS FOR ULTRAVIOLET LIGHT IONIZATION OF NEUTRAL LOST MOLECULES, AND METHOD FOR OPERATING SAME

(71) Applicant: NATIONAL INSTITUTE OF METROLOGY CHINA, Beijing (CN)

(72) Inventors: Xingchuang Xiong, Beijing (CN); Xiang Fang, Beijing (CN); You Jiang, Beijing (CN); Xiaoyun Gong, Beijing (CN); Zejian Huang, Beijing (CN); Meiying Liu, Beijing (CN)

(73) Assignee: NATIONAL INSTITUTE OF METROLOGY CHINA, Beijing (CN)

( * ) Notice: Subject to any disclaimer, the term of this patent is extended or adjusted under 35 U.S.C. 154(b) by 0 days.

(21) Appl. No.: 15/124,382

(22) PCT Filed: Nov. 19, 2015

(86) PCT No.: PCT/CN2015/095020
§ 371 (c)(1),
(2) Date: Sep. 8, 2016

(87) PCT Pub. No.: WO2017/041361
PCT Pub. Date: Mar. 16, 2017

(65) Prior Publication Data

US 2018/0261443 A1 Sep. 13, 2018

(51) Int. Cl.

| | |
|---|---|
| ***H01J 49/26*** | (2006.01) |
| ***H01J 49/34*** | (2006.01) |
| ***H01J 49/42*** | (2006.01) |
| ***H01J 49/00*** | (2006.01) |
| ***H01J 49/04*** | (2006.01) |
| ***H01J 49/36*** | (2006.01) |
| ***H01J 49/16*** | (2006.01) |

(52) U.S. Cl.
CPC ..... *H01J 49/4225* (2013.01); *H01J 49/0031* (2013.01); *H01J 49/0495* (2013.01); *H01J 49/161* (2013.01); *H01J 49/36* (2013.01)

(58) Field of Classification Search
CPC ..... H01J 49/4225; H01J 49/0031; H01J 49/0495; H01J 49/161; H01J 49/36
USPC ..... 250/281, 282, 283, 288
See application file for complete search history.

(56) References Cited

U.S. PATENT DOCUMENTS

2003/0183760 A1* 10/2003 Tsybin ..... H01J 49/0054 250/292
2011/0127416 A1* 6/2011 Campuzano ..... H01J 49/0431 250/282

(Continued)

*Primary Examiner* — Nicole Ippolito
(74) *Attorney, Agent, or Firm* — Bacon & Thomas, PLLC

(57) ABSTRACT

The invention proposes a mass spectrometry apparatus for ultraviolet light ionization of neutral lost molecules, and a method for operating same. The mass spectrometry apparatus for ultraviolet light ionization of neutral lost molecules includes a quadrupole tandem special linear ion trap mass analyzer, a vacuum ultraviolet lamp, a lamp front shutter, a gradient vacuum system and other necessary components for the mass spectrometry apparatus. In addition, the invention also proposes a method for operating the apparatus to efficiently store ions, fragment and analyze the ions, perform ultraviolet efficient ionization on lost neutral molecules, and then analyze the ions.

9 Claims, 2 Drawing Sheets

(56) References Cited

U.S. PATENT DOCUMENTS

| | | | | |
|---|---|---|---|---|
| 2015/0028222 | A1* | 1/2015 | Denning | H01J 27/24 250/424 |
| 2017/0243728 | A1* | 8/2017 | Makarov | H01J 49/0031 |

* cited by examiner

MASS SPECTROMETRY APPARATUS FOR ULTRAVIOLET LIGHT IONIZATION OF NEUTRAL LOST MOLECULES, AND METHOD FOR OPERATING SAME

FIELD OF THE INVENTION

The invention relates to a quadrupole tandem linear ion trap mass spectrometry apparatus system, and in particular to a mass spectrometry apparatus for ultraviolet light ionization of neutral lost molecules.

BACKGROUND OF THE INVENTION

A mass spectrometry method is a method for ionizing material particles (atoms or molecules) into ions, carrying out cytoplasmic-nuclear ratio separation on the ions by means of an appropriate stable or variable electric field or magnetic field in accordance with a spatial position, a time sequence and the like, and detecting the strengths thereof to perform qualitative and quantitative analysis. As the mass spectrometry method is used for directly measuring the material particles and has the characteristics of high sensitivity, high resolution, high flux and high applicability, a mass spectrometer and a mass spectrometry technology play an important role in modern science and technology. With the development of academic subjects such as life sciences, environmental sciences and medicine sciences, and on the basis of requirements for food security, national security and international counter terrorism, the mass spectrometer has become one of analysis instruments with highest demand growth rate. Particularly, as a chromatographic/mass-spectrometric combined technology appears, the technology is popular in all the fields or even indispensable due to a high separation function and high detection sensitivity on complex matrices.

A mass analyzer is a detectable component for separating ions in accordance with a cytoplasmic-nuclear ratio in the mass spectrometer, an ion trap is an important mass analyzer, and the principle of the ion trap is that a plurality of ions are stored in the trap and then separation detection is carried out. Compared with other mass analyzers excluding the ion trap, the mass analyzer including the ion trap can store the ions, and therefore $MS^n$ operations (mass spectrum operations such as MS/MS and MS/MS/MS) can be executed in the mass analyzer including the ion trap. The directions of the ion trap are defined as follows. An axial direction of a front end cover and a rear end cover of the ion trap is a Z direction, a vertical direction is an X direction, and a horizontal direction is a Y direction.

The $MS^n$ operations facilitate provision of structural information of the detected ions which can be called parent ions, and are very significant to accurate and qualitative analysis of the detected ions. The $MS^n$ operations can control identified ions and gas molecules (such as He and $N_2$) to be fragmented due to collision, can also control the identified ions to be cracked due to photon absorption (such as infrared laser), and can also control the identified ions to react with electrons (such as an ECD mode) and anions (such as an ETD mode) to be cracked so as to generate sub-ions. The mass spectrometer further separates these sub-ions, and analyzes the strength of each sub-ion in a cytoplasmic-nuclear ratio (m/z, where m represents a mass number of ions and z represents a charged number of ions), thereby aiding in providing the structural information of the parent ions.

Not only a series of sub-ions of the parent ions are fragmented, but also a great number of neutral molecules which are not charged are fragmented. Due to the fact that these neutral molecules are not charged, the mass analyzer cannot operate the neutral molecules, and information thereof is often invisible, so that the neutral molecules are called lost neutral molecules.

It is very important to identify the structures of the fragmented neutral molecules of the parent ions for a great number of compounds, particularly biological molecules (protein molecules, polypeptide molecules, nucleic acid molecules and the like), and if the fragmented neutral molecules can be accurately, the structural information can be almost perfectly explained, which is a dream for the field of mass spectrometry.

Re-ionization of the fragmented neutral molecules of the parent ions is a possible solution. The neutral molecules in the mass analyzer can be re-ionized by ultraviolet light, and many mass spectrum experts make a lot of effort and tests, with little success.

Re-ionization of the neutral molecules in the mass analyzer by the ultraviolet light has some problems that:

there are very few neutral molecules generated by fragmenting the parent ions;

ultraviolet photons capable of entering the mass analyzer are not enough;

an opportunity (an ionized probability) of accepting the ultraviolet photons by the neutral molecules is not high; and in a word, ions which are successfully ionized by the neutral molecules and the ultraviolet light are very few so as to hardly detect a signal. Moreover, the entire operation time sequence and logics are relatively complex, and it is hard to detect signals of a minority of ionized ions. In addition, the ionization time of the ultraviolet light is required to be accurately controlled, if the ion trap is irradiated by an ultraviolet lamp all the time, patent ions which are not fragmented are not ionized by the ultraviolet light and then cracked often, a mass spectrogram is unfavorably explained, and the difficulty in provision of the structural information is increased.

SUMMARY OF THE INVENTION

In order to solve the problems, the invention proposes a mass spectrometry apparatus for ultraviolet light ionization of neutral lost molecules, and a method for operating same.

In order to achieve the aim, the invention proposes a mass spectrometry apparatus for ultraviolet light ionization of neutral lost molecules, which may include an ion source, an ion trap, an ion import system, a multi-stage gradient vacuum system, a detector configured to carry out separation detection on ions in the ion trap, and a buffer gas injection system configured to inject buffer gas into the ion trap via a gas conduit. Holes may be provided on a front end cover and a rear end cover of the ion trap. The multi-stage gradient vacuum system may include a plurality of vacuum intervals of which gas pressures drop successively, a through hole being provided on each vacuum interval. The ion import system may include an ion import pipeline communicated with the ion source and ion guidance pipelines arranged in all the vacuum intervals of the multi-stage gradient vacuum system. A port of each ion guidance pipeline may directly face the through hole connected between the corresponding vacuum interval and the vacuum interval adjacent thereto. The ion trap may be located in the last vacuum interval of the multi-stage gradient vacuum system. The buffer gas injection system may inject the buffer gas into the ion trap via the front end cover or the rear end cover of the ion trap. The detector may include two detectors which are symmetrically arranged at two sides of the ion trap. The mass spectrometry apparatus may further include a vacuum ultraviolet lamp system, the vacuum ultraviolet lamp system being arranged at the rear end of the ion trap, ultraviolet light being emitted into the ion trap via an ion export hole in the rear end cover of the ion trap, and an inner surface of the ion trap being coated with an aluminium alloy film layer.

Holes may be provided in the centres of the front end cover and the rear end cover. A plurality of buffer gas export holes may be annularly and uniformly distributed around each hole, annular gas export cover plates may be arranged outside the front end cover and the rear end cover, annular cavities may be formed between the front end cover and the annular cover plate adjacent thereto and between the rear end cover and the annular cover plate adjacent thereto, and a buffer gas vent hole on the front end cover may be communicated with the corresponding annular cavity. The gas export cover plates may be conductive insulators, the front end cover and the rear end cover may be conductive electrode slices, and the thickness of each conductive electrode slice may be 0.8-1.2 mm. The diameters of the holes on the front end cover and the rear end cover may be 2 mm, the area of each hole may be about 21.571 $mm^2$, the diameter of the buffer gas vent hole may be 1 mm, the area may be about 0.393 $mm^2$, and a centre distance between the hole on the front end cover and the buffer gas vent hole may be about 1.5 mm.

Preferably, the mass spectrometry apparatus for ultraviolet light ionization of neutral lost molecules may further include a quadrupole system, the quadrupole system and the ion trap being located in the same vacuum interval and arranged in front of the front end cover of the ion trap.

Preferably, the mass spectrometry apparatus for ultraviolet light ionization of neutral lost molecules may further include a vacuum ultraviolet lamp system, the vacuum ultraviolet lamp system including a lamp front shutter and an ultraviolet lamp, the lamp front shutter being arranged in front of a light emergence end of the ultraviolet lamp, the lamp front shutter and the rear end cover of the ion trap being arranged at an interval, a sealing apparatus being arranged outside the rear end cover of the ion trap and the vacuum ultraviolet lamp system, and the sealing apparatus isolating communication of the rear end cover of the ion trap and the vacuum ultraviolet lamp system with an external vacuum interval.

Preferably, the quadrupole system may include a mass filtering quadrupole and a shaping quadrupole, the mass filtering quadrupole being arranged in front of the shaping quadrupole, a front end of the mass filtering quadrupole directly facing the through hole communicated between a previous vacuum interval and the corresponding vacuum interval, and a rear end of the shaping quadrupole directly facing the hole in the front end cover of the ion trap.

Preferably, a front end cover shutter may be arranged between the shaping quadrupole and the front end cover of the ion trap, and the front end cover shutter, the shaping quadrupole and the front end cover of the ion trap may be arranged at intervals.

Preferably, the ion trap may further include four electrodes which are arranged in X and Y directions of the ion trap respectively and are symmetric two to two. The inner surface of the ion trap may include a side surface, facing the ion trap, of the front end cover shutter, a surface of the front end cover of the ion trap, surfaces of the electrodes in the ion trap and a surface of the rear end cover of the ion trap.

Preferably, an ion lens may be arranged at the tail end of the ion guidance pipeline arranged in a previous vacuum interval with respect to the vacuum interval where the ion trap is located.

Preferably, an ion detection slit may be provided at a part, correspondingly provided with the detector, of the side surface of the ion trap.

A method for operating a mass spectrometry apparatus for ultraviolet light ionization of neutral lost molecules may successively include the steps as follows.

I: In an initialization phase, an ultraviolet light ionization spectral dataset A for background molecules in an ion trap before designated ions to be detected do not enter the ion trap is obtained;

it is detected whether electrical parameters of a mass spectrometry apparatus and a vacuum degree in each vacuum interval of a multi-stage gradient vacuum system are normal;

if it is confirmed that the electrical parameters and the vacuum degree are normal, a voltage is exerted on an ion lens, so that a channel between an ion source and the ion trap is closed, and meanwhile, a front end cover shutter is opened; and if it is confirmed that the electrical parameters and the vacuum degree are abnormal, it is necessary to adjust the corresponding abnormal electrical parameters and/or the vacuum degree of each vacuum interval, and subsequent operations are executed according to the operations in case of normality confirmation after a normal range is reached.

II: In an ionization phase, exertion of the voltage on the ion lens is stopped, so that the channel between the ion source and the ion trap is opened, the ion source generates ions, the ions enter a quadrupole system through an ion import pipeline, an ion guidance pipeline and the ion lens, a radio frequency voltage is exerted on the quadrupole system to form a quadrupole electric field, a direct current voltage is exerted on the quadrupole system to form a mass filter of the quadrupole electric field, and it is ensured that the designated ions pass through the quadrupole system and other ions are excluded; and the designated ions are shaped by the shaping quadrupole and then enter the ion trap, and the designated ions are continuously input into the ion trap until the designated ions in the ion trap are saturated (judgement whether the ions in the ion trap are saturated has a conventional cognition, and when the ions in the ion trap are saturated, a direct Coulomb acting force between the ions cannot be ignored so as to influence the action effect of a radio frequency electric field on the ions).

III: In an ion cooling phase, buffer gas has been injected into the ion trap by this time so as to collide with the designated ions entering the ion trap, thereby lowering the kinetic energy of the designated ions.

IV: In an isolation preparation phase of designated ions, a radio frequency voltage for detecting ions is exerted on the ion trap gradually to form a corresponding radio frequency voltage when q is about 0.8, and the q is calculated according to the following formula:

$$q = \frac{8eV_{RF}}{m(r^2 + 2z^2)\Omega^2} = \frac{8V_{RF}}{(r^2 + 2z^2)\Omega^2} * \left(\frac{e}{m}\right) \quad (1)$$

where, $\left(\frac{e}{m}\right)$ is a cytoplasmic-nuclear ratio reciprocal of ions, $V_{RF}$ is a radio frequency voltage amplitude, Ω is a frequency value of a radio frequency voltage, r is a shortest distance value from a centre point of the ion trap to an electrode in an X direction or a Y direction, and z is a distance value from the centre point of the ion trap to an end cover in a Z direction; and for designated ions, compared with other voltage values, the designated ions at this time are most stable in the ion trap and are most unlikely to escape from the ion trap, in other words, the voltage values at this time are radio frequency voltage values capable of firmly capturing the designated ions, however, this effect is not achieved for non-isolated ions.

V: In an isolation phase of designated ions, a waveform is exerted on the electrode in the X direction of the ion trap, and the frequency of the waveform is frequency after the movement frequency of the designated ions in the X direction is eliminated within a range of 10 kHZ to 500 kHZ, so that other ions other than the designated ions are expelled from the ion trap to complete further separation on the designated ions and the other ions.

VI: In an isolation following phase of designated ions, a radio frequency voltage on the ion trap gradually drops to a corresponding radio frequency voltage value when q is 0.25, and preparations are made for following ions.

VII: In an ion fragmenting phase, a radio frequency voltage amplitude on the ion trap is set as a corresponding radio frequency voltage value when q is 0.25, a selective resonance alternating current voltage of the electrode in the X direction is set to be identical to the frequency of designated ions in the X direction so as to form resonance, and the designated ions collide with buffer gas molecules so as to generate ion fragments and neutral lost molecules by breaking chemical bonds of the ions; and a selective resonance alternating current voltage amplitude under this frequency is too small to resonate the ions out of the ion trap, and excitation signals are given to the designated ions, so that the designated ions quickly collide with surrounding buffer gas to be heated to break the chemical bonds, the vibration amplitude of the ions is small and quick at this time, when the alternating current voltage amplitude is increased, collision energy is high, if the energy is too high, the ions will be resonated out of the ion trap, and a breakage effect cannot be generated.

VIII: In an ion detection phase, a radio frequency voltage amplitude is gradually increased on the premise of remaining a radio frequency voltage frequency exerted on the ion trap unchanged, an amplitude will be gradually increased on the premise of remaining a selective resonance alternating current voltage frequency of the X direction unchanged, when the radio frequency voltage rises to a corresponding radio frequency voltage value when q is less than 0.908 and greater than 0.2, fragmented ions with different cytoplasmic-nuclear ratios in the ion trap move in the X direction in accordance with respective movement frequency, when the frequency of the fragmented ions is exactly identical to the alternating current voltage frequency exerted on the X direction, resonance occurs, the fragmented ions are expelled from the ion trap so as to be detected, and an ion fragment spectral dataset B for designated ions is obtained.

IX: In an ultraviolet light ionization chemical phase, when ion fragments are expelled within 10 ms behind the ion trap, some neutral gas molecules generated by fragmentation exist in the ion trap, a lamp front shutter is opened, an ultraviolet lamp irradiates the neutral gas molecules in the ion trap to ionize the neutral gas molecules, and a radio frequency voltage on the ion trap captures ions ionized by ultraviolet light until the ions are accumulated to a signal detectable degree.

X: In an ion detection phase, according to the operations in Step VIII, the ions ionized by the ultraviolet light are expelled from the ion trap in accordance with a cytoplasmic-nuclear ratio, the signal strength is detected, and an ion spectral dataset C for ultraviolet light ionization of molecules in the ion trap is obtained.

XI: In a scanning stop phase, each electrical parameter of the mass spectrometry apparatus and each vacuum interval of the multi-stage gradient vacuum system are recovered to an initial state.

The mass spectrometry apparatus for ultraviolet light ionization of neutral lost molecules has some obvious advantages as follows.

1. The quantity of designated parent ions is obviously increased to reach over 1 million or 10 million ions, and accordingly, fragmented neutral molecules are obviously increased. The apparatus ensures realization of the characteristic in two aspects: firstly, the quadrupole system at the front end of the ion trap ensures that only designated ions are allowed to enter the ion trap and the designated ions can be greatly enriched until the ion trap is saturated, all ions will not enter the ion trap, and non-designated ions will not be expelled; and secondly, the ion storage capacity of a growth linear ion trap is improved by over 1,000 times with respect to that of a Three-dimensional (3D) ion trap.

2. The flowing quantity of neutral molecules obtained by fragmenting the designated parent ions out of the ion trap is obviously decreased, in order that a plurality of neutral molecules participate in light ionization. The apparatus ensures realization of the characteristic by controlling the gas tightness of the ion trap, two large-aperture gas outlet holes (holes in the front and rear end covers) among four gas outlet holes are closed, and the quantity of the neutral molecules flowing out due to the fact that the inner gas pressure of the ion trap is higher than the outer gas pressure of the ion trap is obviously decreased.

3. The probability of ultraviolet light ionization of the neutral molecules obtained by fragmenting the designated parent ions is obviously improved to obtain higher ionization efficiency. Ultraviolet light can be repeatedly reflected inside the ion trap by coating the inner surface of the ion trap with an aluminium alloy film, and a great number of ultraviolet photons will not be absorbed by stainless steel forming the ion trap, so that the hitting probability of the ultraviolet photons against the neutral molecules is obviously improved, and the ionization efficiency is higher.

To sum up, the invention is capable of obviously improving the efficiency of ultraviolet light ionization of the neutral molecules obtained by fragmenting the designated parent ions, the light ionization of a great number of neutral molecules is realized, the fragmented ion information of the designated parent ions is obtained, the neutral molecule information of the designated parent ions can be obtained, and the structural information of the parent ions can be more accurately explained, thereby being particularly favourable to accurate identification of biological peptide fragment molecules. Meanwhile, the apparatus has the characteristics of low realization cost, simple control and the like, and can be used as a widely applied mass spectrometer system.

DETAILED DESCRIPTION OF THE PREFERRED EMBODIMENTS

Figure 1:
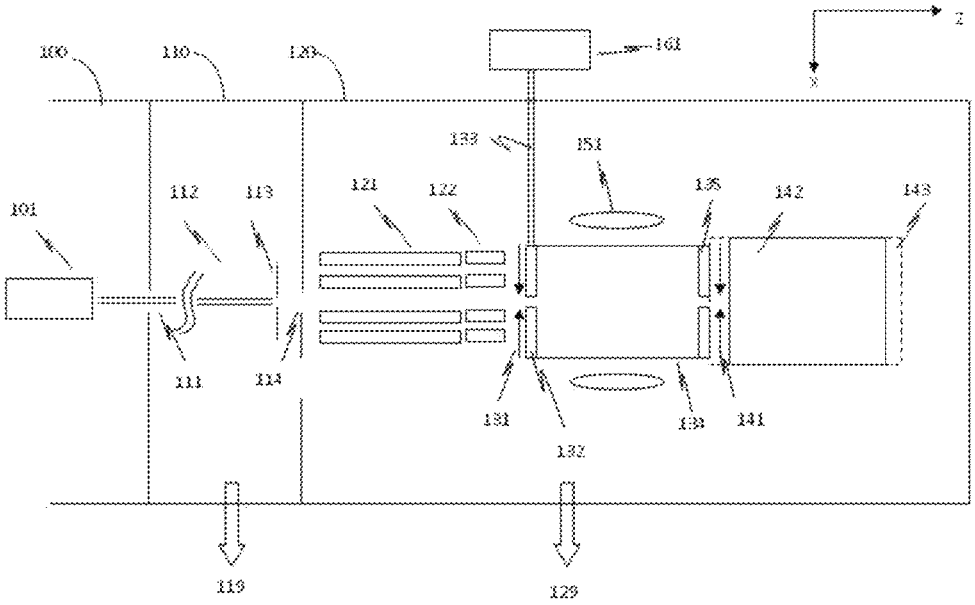
FIG. 1 is a diagram of a mass spectrometry apparatus system for ultraviolet light ionization of neutral lost molecules.
Figure 2:
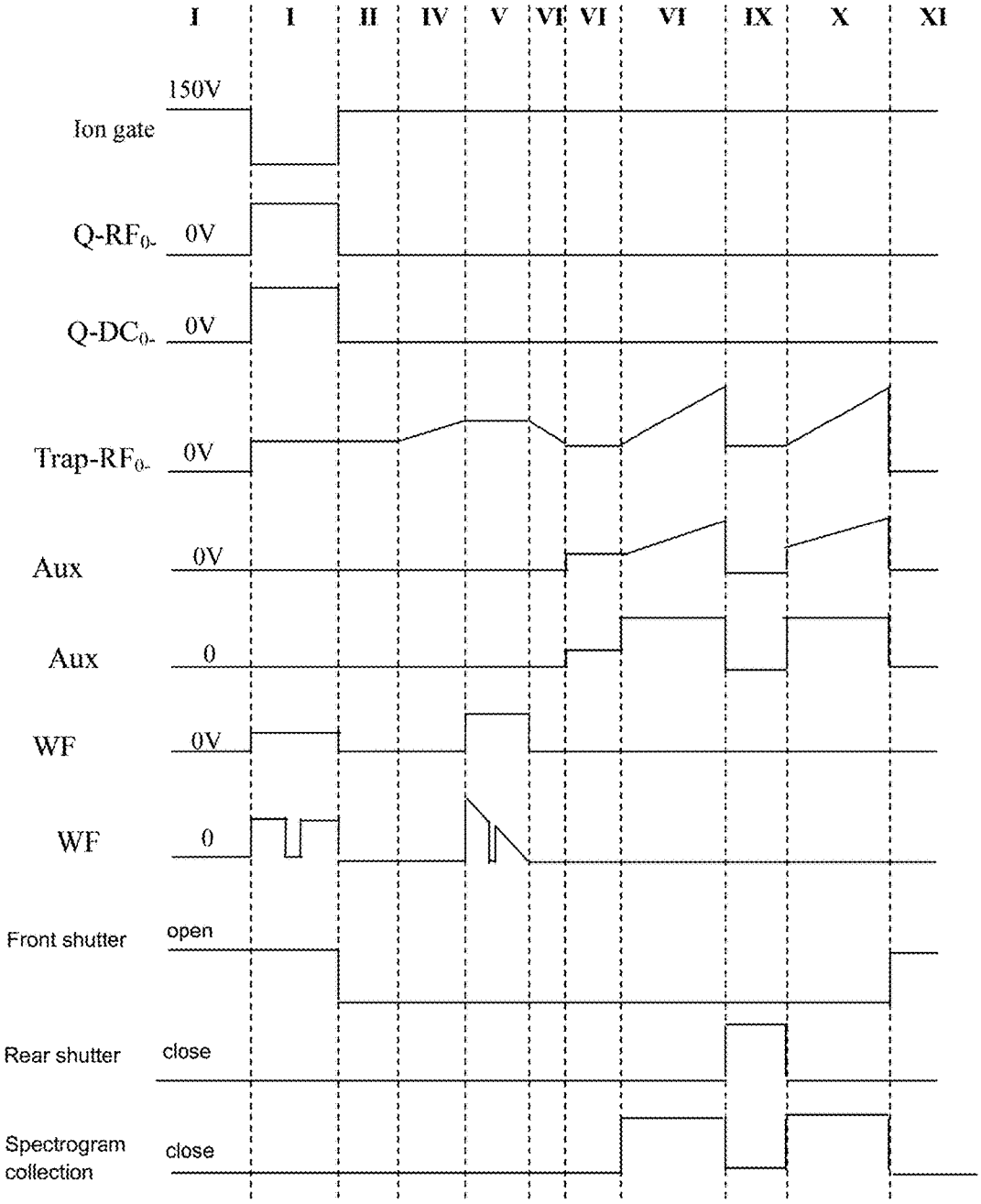
FIG. 2 is a diagram of an operation time sequence of a mass spectrometry apparatus system for ultraviolet light ionization of neutral lost molecules.

The invention is specifically described below with reference to the drawings 1-2.

A mass spectrometry apparatus for ultraviolet light ionization of neutral lost molecules includes an ion source 101, an ion trap 134, an ion import system, a multi-stage gradient vacuum system 110, a detector 151 configured to carry out separation detection on ions in the ion trap 134, and a buffer gas injection system 161 configured to inject buffer gas into the ion trap 134 via a gas conduit 133. Holes are provided on a front end cover 132 and a rear end cover 135 of the ion trap 134. The multi-stage gradient vacuum system 110 includes a plurality of vacuum intervals of which gas pressures drop successively, a through hole being provided on each vacuum interval. The ion import system includes an ion import pipeline communicated with the ion source 101 and ion guidance pipelines arranged in all the vacuum intervals of the multi-stage gradient vacuum system 110. A port of each ion guidance pipeline directly faces the through hole connected between the corresponding vacuum interval and the vacuum interval adjacent thereto. The ion trap 134 is located in the last vacuum interval 120 of the multi-stage gradient vacuum system 110. The buffer gas injection system 161 injects the buffer gas into the ion trap 134 via the front end cover 132 (as the rear end cover 135 is complex in design, it is better to connect a gas vent hole of the buffer gas injection system 161 to the front end cover 132) of the ion trap 134. The detector 151 includes two detectors 151 which are symmetrically arranged at two sides of the ion trap 134. The mass spectrometry apparatus further includes a vacuum ultraviolet lamp 142 system, the vacuum ultraviolet lamp 142 system being arranged at the rear end of the ion trap 134, ultraviolet light being emitted into the ion trap 134 via an ion export hole in the rear end cover 135 of the ion trap 134, and an inner surface of the ion trap 134 being coated with an aluminium alloy film layer (configured to reflect the ultraviolet light). The inner surface of the ion trap 134 includes a side surface of a front end cover shutter 131, a surface of the front end cover 132, surfaces of four electrodes in X and Y directions inside the ion trap 134 and a surface, coated with an aluminium alloy film, of the rear end cover 135. Forming of an electric field is not influenced, ultraviolet photons are not absorbed, and the reflection of the ultraviolet light is increased.

The gas pressure of the last vacuum interval of the multi-stage gradient vacuum system 110 is $10^{-5}$ Torr generally, every two adjacent vacuum intervals are communicated through a certain small hole (such as a through hole 114), the multi-stage gradient vacuum system 110 is communicated with a standard atmospheric pressure interval 100 via an ion import pipeline 111, the ions emitted by the ion source 101 enter the multi-stage gradient vacuum system 110 through the ion import pipeline 111, and an ion guidance pipeline 112 is in charge of transferring ions in the multi-stage gradient vacuum system 110. Molecular pumps (such as a molecular pump 119 and a molecular pump 129) having different pumping speeds are in charge of vacuumizing all the vacuum intervals of the multi-stage gradient vacuum system 110.

An ion lens 113 is arranged at the tail end of the ion guidance pipeline 112 arranged in a previous vacuum interval with respect to the vacuum interval where the ion trap 134 is located. The ion lens 113 is in charge of controlling transmission of the ions to the rear end, and is called an ion gate.

The front end cover shutter 131 of the ion trap 134 is opened when the ions are imported into the ion trap 134 and is closed when designated parent ions are fragmented so as to prevent neutral molecules from overflowing out of a front end hole. An opening hole of the front end cover shutter 131 of the ion trap 134 is relatively large, so as not to influence normal import of the ions. Holes of about 2 mm are provided in the centres of the front end cover 132 and the rear end cover 135. The hole of the front end cover 132 is configured for ion import, and the hole of the rear end cover 135 and the hole of the front end cover 132 are correspondingly symmetric. The front end cover 132, the ion trap 134 and the rear end cover 135 form a complete linear ion trap mass analyzer system, electric conduction is realized, and a corresponding direct current voltage is exerted; and radio frequency voltages are exerted on electrodes in the X and Y directions of the ion trap 134, and a high-frequency alternating current is exerted on the X direction. The combined implementation of these voltages forms an electric field to achieve operations such as ion storage, separation, collision between ions and molecules, and ion expelling. In order to store more ions, the length of an electrode in a Z direction among four symmetric electrodes of the ion trap 134 can be appropriately increased in case of remaining the electric field in the X and Y directions.

The quadrupole system and the ion trap 134 are located in the same vacuum interval and are arranged in front of the front end cover 132 of the ion trap 134. The quadrupole system includes a mass filtering quadrupole 121 and a shaping quadrupole 122, the mass filtering quadrupole 121 being arranged in front of the shaping quadrupole 122, a front end of the mass filtering quadrupole 121 directly facing the through hole communicated between a previous vacuum interval and the corresponding vacuum interval, and a rear end of the shaping quadrupole 122 directly facing the hole in the front end cover 132 of the ion trap 134. The mass filtering quadrupole 121 is configured to select designated parent ions and only allow the passage of the designated parent ions. The shaping quadrupole 122 has an ion shaping function and allows the ions passing through the mass filtering quadrupole 121 to smoothly enter the ion trap 134 behind.

The vacuum ultraviolet lamp 142 system includes a lamp front shutter 141 and an ultraviolet lamp 142 (capable of emitting ultraviolet light greater than or equal to 10.6 eV photon energy), the lamp front shutter 141 being arranged in front of a light emergence end of the ultraviolet lamp 142, the lamp front shutter 141 and the rear end cover 135 of the ion trap 134 being arranged at an interval of less than 10 mm, a sealing apparatus 143 being arranged outside the rear end cover 135 of the ion trap 134 and the vacuum ultraviolet lamp 142 system, and the sealing apparatus 143 isolating communication of the rear end cover 135 of the ion trap 134 and the vacuum ultraviolet lamp 142 system with an external vacuum interval 120. When the lamp front shutter 141 is opened, entry of the ultraviolet light into the ion trap 134 is not influenced, and when the lamp front shutter 141 is closed, photons can be effectively prevented from entering the ion trap 134. The sealing apparatus 143 is in charge of the gas tightness of the rear end cover 135 of the ion trap 134, the lamp front shutter 141 and the ultraviolet lamp 142, prevents neutral molecules from entering the vacuum interval 120 from the rear end cover 135, and prevents neutral gas molecules from remaining in a space due to low dead volume of own gas.

A front end cover shutter 131 is arranged between the shaping quadrupole 122 and the front end cover 132 of the ion trap 134, and the front end cover shutter 131, the shaping quadrupole 122 and the front end cover 132 of the ion trap 134 are arranged at intervals.

An ion detection slit is provided at a part, correspondingly provided with the detector 151, of the side surface of the ion trap 134. The ion detection slit is a 30 mm*0.25 mm slit, and the area of the slit is about 2*0.5 $mm^2$.

A method for operating a mass spectrometry apparatus for ultraviolet light ionization of neutral lost molecules successively includes the steps as follows.

I: In an initialization phase, an ultraviolet light ionization spectral dataset A for background molecules in an ion trap 134 before designated ions (which are named S+ and may be small organic molecule ions, peptide fragment ions, polypeptide ions, small protein ions and the like) to be detected do not enter the ion trap 134 is obtained;

it is detected whether electrical parameters of a mass spectrometry apparatus and a vacuum degree in each vacuum interval of a multi-stage gradient vacuum system 110 are normal;

if it is confirmed that the electrical parameters and the vacuum degree are normal, a voltage is exerted on an ion lens, so that a channel between an ion source 101 and the ion trap 134 is closed, and meanwhile, a front end cover shutter 131 is opened; and if it is confirmed that the electrical parameters and the vacuum degree are abnormal, it is necessary to adjust the corresponding abnormal electrical parameters and/or the vacuum degree of each vacuum interval, and subsequent operations are executed according to the operations in case of normality confirmation after a normal range is reached.

The electrical parameters include: a voltage, exerted on an ion lens 113 by an ion gate and intended to control whether ions are transmitted to a rear end;

a radio frequency voltage, exerted on a mass filtering quadrupole 121 by a Q-RF;

a direct current voltage, exerted on the quadrupole 121 by a Q-DC, wherein a certain linear relationship is kept between the Q-DC and the voltage amplitude of the Q-RF to form a mass filter for a quadrupole electric field having a designated ion unit mass resolution, after the Q-RF and the corresponding Q-DC are given, ions only within a certain range (from mzX−mz to mzX+mz) (for example, from Xamu−0.5 amu to Xamu+0.5 amu) can pass through the mass filtering quadrupole 121, other ions cannot pass through the mass filtering quadrupole 121, and a direct current exerted on the shaping quadrupole 122 at the rear end is 0;

a radio frequency voltage, exerted on the ion trap 134 (a slit is set to be in an X direction and is intended to detect ions) by a Trap-RF, wherein the Trap-RF is configured to capture the ions entering the ion trap 134, can be independently exerted on a pair of electrodes in a Y direction, or can also be exerted on a pair of electrodes in the X direction in addition to the pair of electrodes in the Y direction (the voltage amplitudes of the X direction and the Y direction are identical, and a phase difference is 180 degrees);

an amplitude of a high-frequency alternating current, exerted on the electrodes in the X direction of the ion trap 134 by an Aux Amp, wherein in order to detect ions with a specific movement frequency in the X direction, the exertion of the alternating current voltage is intended to resonate the ions with the specific movement frequency, the ions are expelled from the ion trap 134 so as to achieve the aim of being detected, and usually, an ion having a large m/z value has a large Aux Amp value;

a frequency of the high-frequency alternating current, exerted on the electrodes in the X direction of the ion trap 134 by an Aux Fre, wherein if the frequency is equal to a movement frequency of specific ions in the X direction, resonance can be generated in the X direction, usually, the Aux Fre remains unchanged at a certain frequency, the frequency of a lot of ions in the X direction is increased by controlling the Trap-RF amplitude, and the ions are resonated to be expelled from the ion trap 134 when the frequency reaches the Aux Fre, so that the ions are detected;

an amplitude of a specific waveform, exerted on the electrodes in the X direction of the ion trap 134 by a WF Amp, wherein the specific waveform is intended to expel other ions, except designated ions, from the ion trap 134, and only the designated ions are retained in the ion trap 134; and a frequency of a specific waveform, exerted on the electrodes in the X direction of the ion trap 134 by a WF Fre, wherein the specific waveform is intended to expel other ions, except designated ions, from the ion trap 134, only the designated ions are retained in the ion trap 134, usually, frequency components of the WF Fre contain frequency components of 10 k-500 k HZ and do not contain the movement frequency of the designated ions in the X direction, and other ions except the designated ions can be resonated in the X direction, so that the ions are expelled from the ion trap 134.

A front shutter namely a front end cover shutter 131 prevents gas molecules in the ion trap 134 from being drawn away from a front segment of the ion trap 134.

A rear shutter namely a lamp front shutter 141 has a function of preventing ultraviolet light from being irradiated into the ion trap 134 so as to influence molecules and ions in a non-ultraviolet light ionization phase, and when the ultraviolet light is needed, the lamp front shutter 141 is opened, and the ultraviolet light is irradiated into the ion trap 134.

Spectrogram collection refers to expelling of the ions from the ion trap 134 orderly and regularly, a detector 151 detects an ion signal, a data collection system obtains time-varying data of the ion signal, and then the data is subsequently converted into ion signal strength data of a cytoplasmic-nuclear ratio (m/z).

II: In an ionization phase, exertion of the voltage on the ion lens is stopped, so that the channel between the ion source 101 and the ion trap 134 is opened, the ion source 101 generates ions, the ions enter a quadrupole system through an ion import pipeline, an ion guidance pipeline and the ion lens, a radio frequency voltage is exerted on the quadrupole system to form a quadrupole electric field, a direct current voltage is exerted on the quadrupole system to form a mass filter of the quadrupole electric field, and it is ensured that the designated ions pass through the quadrupole system and other ions are excluded; and the designated ions are shaped by the shaping quadrupole 122 and then enter the ion trap 134, and the designated ions are continuously input into the ion trap 134 until the designated ions in the ion trap 134 are saturated. The quadrupole electric field is formed in an interval in the mass filtering quadrupole 121, the frequency of the radio frequency voltage exerted on the shaping quadrupole 122 is identical to the Q-RF, the voltage amplitude is often one third of the Q-RF amplitude, the voltages (voltage amplitudes and frequencies) exerted on two electrodes in the X direction by the Q-RF are identical, and the voltages (voltage amplitudes and frequencies) exerted on two electrodes in the Y direction are identical. However, the voltage amplitudes of the X direction and the Y direction are identical, and a difference between frequency phases is 180 degrees. In this phase, the Q-RF and the Q-DC on the mass filtering quadrupole 121 are combined to only allow designated ions S+ to pass through the mass filtering quadrupole 121, other ions are excluded, and after the ions pass through the mass filtering quadrupole 121, the shaping quadrupole 122 at the rear end is shaped to enter the ion trap 134.

III: In an ion cooling phase, buffer gas is injected into the ion trap 134, so that buffer gas molecules (inert gas such as He and Ar) collide with the designated ions entering the ion trap 134, thereby lowering the kinetic energy of the designated ions.

IV: In an isolation preparation phase of designated ions, a radio frequency voltage for detecting ions is exerted on the ion trap 134 gradually to form a corresponding radio frequency voltage when q is 0.8, and the q is calculated according to the following formula:

$$q = \frac{8eV_{RF}}{m(r^2+2z^2)\Omega^2} = \frac{8V_{RF}}{(r^2+2z^2)\Omega^2} * \left(\frac{e}{m}\right) \quad (1)$$

where, $$\left(\frac{e}{m}\right)$$

is a cytoplasmic-nuclear ratio reciprocal of ions, $V_{RF}$ is a radio frequency voltage amplitude, Ω is a frequency value of a radio frequency voltage, r is a shortest distance value from a centre point of the ion trap 134 to an electrode in an X direction or a Y direction, and z is a distance value from the centre point of the ion trap 134 to an end cover in a Z direction.

V: In an isolation phase of designated ions, a waveform is exerted on the electrode in the X direction of the ion trap 134, and the frequency of the waveform is frequency after the movement frequency of the designated ions in the X direction is eliminated within a range of 10 kHZ to 500 kHZ, so that other ions other than the designated ions are expelled from the ion trap 134 to complete further separation on the designated ions and the other ions.

VI: In an isolation following phase of designated ions, a radio frequency voltage on the ion trap 134 gradually drops to a corresponding radio frequency voltage value when q is 0.25, and preparations are made for following ions.

VII: In an ion fragmenting phase, a radio frequency voltage amplitude on the ion trap 134 is set as a corresponding radio frequency voltage value when q is 0.25, a selective resonance alternating current voltage of the electrode in the X direction is set to be identical to the frequency of designated ions in the X direction so as to form resonance, and the designated ions collide with buffer gas molecules (inert gas such as He, $N_2$ and Ar) so as to generate ion fragments and neutral lost molecules by breaking chemical bonds of the ions; and a selective resonance alternating current voltage amplitude under this frequency is too small to resonate the ions out of the ion trap, and excitation signals are given to the designated ions, so that the designated ions quickly collide with surrounding buffer gas to be heated to break the chemical bonds, the vibration amplitude of the ions is small and quick at this time, when the alternating current voltage amplitude is increased, collision energy is high, if the energy is too high, the ions will be resonated out of the ion trap, and a breakage effect cannot be generated.

VIII: In an ion detection phase, a radio frequency voltage amplitude is gradually increased on the premise of remaining a radio frequency voltage frequency exerted on the ion trap 134 unchanged, an amplitude will be gradually increased on the premise of remaining a selective resonance alternating current voltage frequency of the X direction unchanged, when the radio frequency voltage rises to a corresponding radio frequency voltage value when q is less than 0.908 and greater than 0.2, fragmented ions with different cytoplasmic-nuclear ratios in the ion trap 134 move in the X direction in accordance with respective movement frequency, when the frequency of the fragmented ions is exactly identical to the alternating current voltage frequency exerted on the X direction, resonance occurs, the fragmented ions are expelled from the ion trap 134 so as to be detected, and an ion fragment spectral dataset B for designated ions is obtained. Usually, ions have a high cytoplasmic-nuclear ratio, and the alternating current voltage amplitude value is large accordingly within the same resonance time.

IX: In an ultraviolet light ionization chemical phase, when ion fragments are expelled within 10 ms behind the ion trap 134, some neutral gas molecules generated by fragmentation exist in the ion trap 134, the lamp front shutter 141 is opened, an ultraviolet lamp 142 irradiates the neutral gas molecules in the ion trap 134 to ionize the neutral gas molecules, and a radio frequency voltage on the ion trap 134 captures ions ionized by ultraviolet light until the ions are accumulated to a signal detectable degree.

X: In an ion detection phase, according to the operations in Step VIII, the ions ionized by the ultraviolet light are expelled from the ion trap 134 in accordance with a cytoplasmic-nuclear ratio, the signal strength is detected, and an ion spectral dataset C for ultraviolet light ionization of molecules in the ion trap 134 is obtained.

XI: In a scanning stop phase, each electrical parameter of the mass spectrometry apparatus and each vacuum interval of the multi-stage gradient vacuum system 110 are recovered to an initial state. It is ensured that each parameter is safe under the condition of long-time stop.

According to post data processing, an ultraviolet light ionization spectral dataset A for background molecules in the ion trap 134 is excluded from an ultraviolet light ionization spectral dataset C containing neutral molecules obtained by fragmenting the designated ions in the ion trap 134 so as to obtain neutral molecule information obtained by fragmenting the designated ions. With reference to a fragmented ion spectral dataset B for the designated ions, the structural information of the designated ions can be more accurately and comprehensively parsed.

Certainly, the invention can also have multiple other embodiments. Those skilled in the art can make various corresponding variations and modifications according to the invention without departing from the spirit and essence of the invention, but these corresponding variations and modifications shall fall within the protection scope of attached claims of the invention.

What is claimed is:

1. A mass spectrometry apparatus for ultraviolet light ionization of neutral lost molecules, comprising an ion source, an ion trap, an ion import system, a multi-stage gradient vacuum system, a detector configured to carry out separation detection on ions in the ion trap, and a buffer gas injection system configured to inject buffer gas into the ion trap via a gas conduit, wherein holes are provided on a front end cover and a rear end cover of the ion trap; the multi-stage gradient vacuum system comprises a plurality of vacuum intervals of which gas pressures drop successively, a through hole being provided on each vacuum interval; the ion import system comprises an ion import pipeline communicated with the ion source and ion guidance pipelines arranged in all the vacuum intervals of the multi-stage gradient vacuum system; a port of each ion guidance pipeline directly faces the through hole connected between the corresponding vacuum interval and the vacuum interval adjacent thereto; the ion trap is located in the last vacuum interval of the multi-stage gradient vacuum system; the buffer gas injection system injects the buffer gas into the ion trap via the front end cover or the rear end cover of the ion trap; the detector comprises two detectors which are symmetrically arranged at two sides of the ion trap; and the mass spectrometry apparatus further comprises a vacuum ultraviolet lamp system, the vacuum ultraviolet lamp system being arranged at the rear end of the ion trap, ultraviolet light being emitted into the ion trap via an ion export hole in the rear end cover of the ion trap, and an inner surface of the ion trap being coated with an aluminium alloy film layer.

2. The mass spectrometry apparatus for ultraviolet light ionization of neutral lost molecules according to claim 1, further comprising a quadrupole system, the quadrupole system and the ion trap being located in the same vacuum interval and arranged in front of the front end cover of the ion trap.

3. The mass spectrometry apparatus for ultraviolet light ionization of neutral lost molecules according to claim 1, further comprising a vacuum ultraviolet lamp system, the vacuum ultraviolet lamp system comprising a lamp front shutter and an ultraviolet lamp, the lamp front shutter being arranged in front of a light emergence end of the ultraviolet lamp, the lamp front shutter and the rear end cover of the ion trap being arranged at an interval, a sealing apparatus being arranged outside the rear end cover of the ion trap and the vacuum ultraviolet lamp system, and the sealing apparatus isolating communication of the rear end cover of the ion trap and the vacuum ultraviolet lamp system with an external vacuum interval.

4. The mass spectrometry apparatus for ultraviolet light ionization of neutral lost molecules according to claim 2, wherein the quadrupole system comprises a mass filtering quadrupole and a shaping quadrupole, the mass filtering quadrupole is arranged in front of the shaping quadrupole, a front end of the mass filtering quadrupole directly faces the through hole communicated between a previous vacuum interval and the corresponding vacuum interval, and a rear end of the shaping quadrupole directly faces the hole in the front end cover of the ion trap.

5. The mass spectrometry apparatus for ultraviolet light ionization of neutral lost molecules according to claim 4, wherein a front end cover shutter is arranged between the shaping quadrupole and the front end cover of the ion trap, and the front end cover shutter, the shaping quadrupole and the front end cover of the ion trap are arranged at intervals.

6. The mass spectrometry apparatus for ultraviolet light ionization of neutral lost molecules according to claim 5, wherein the ion trap further comprises four electrodes which are arranged in X and Y directions of the ion trap respectively and are symmetric two to two; and the inner surface of the ion trap comprises a side surface, facing the ion trap, of the front end cover shutter, a surface of the front end cover of the ion trap, surfaces of the electrodes in the ion trap and a surface of the rear end cover of the ion trap.

7. The mass spectrometry apparatus for ultraviolet light ionization of neutral lost molecules according to any one of claims 1 to 6, wherein an ion lens is arranged at the tail end of the ion guidance pipeline arranged in a previous vacuum interval with respect to the vacuum interval where the ion trap is located.

8. The mass spectrometry apparatus for ultraviolet light ionization of neutral lost molecules according to claim 1, wherein an ion detection slit is provided at a part, correspondingly provided with the detector, of the side surface of the ion trap.

9. A method for operating a mass spectrometry apparatus for ultraviolet light ionization of neutral lost molecules, successively comprising:

I: in an initialization phase, obtaining an ultraviolet light ionization spectral dataset A for background molecules in an ion trap before designated ions to be detected do not enter the ion trap;

detecting whether electrical parameters of a mass spectrometry apparatus and a vacuum degree in each vacuum interval of a multi-stage gradient vacuum system are normal;

if it is confirmed that the electrical parameters and the vacuum degree are normal, exerting a voltage on an ion lens so as to close a channel between an ion source and the ion trap, and opening a front end cover shutter; and if it is confirmed that the electrical parameters and the vacuum degree are abnormal, adjusting the corresponding abnormal electrical parameters and/or the vacuum degree of each vacuum interval, and executing subsequent operations according to the operations in case of normality confirmation after a normal range is reached;

II: in an ionization phase, stopping exerting the voltage on the ion lens so as to open the channel between the ion source and the ion trap, generating ions by the ion source to make the ions enter a quadrupole system through an ion import pipeline, an ion guidance pipeline and the ion lens, exerting a radio frequency voltage on the quadrupole system to form a quadrupole electric field, exerting a direct current voltage on the quadrupole system to form a mass filter of the quadrupole electric field, ensuring that the designated ions pass through the quadrupole system and other ions are excluded, shaping the designated ions by the shaping quadrupole to make the designated ions enter the ion trap, and continuously inputting the designated ions into the ion trap until the designated ions in the ion trap are saturated;

III: in an ion cooling phase, injecting buffer gas into the ion trap, so that the buffer gas collides with the designated ions entering the ion trap, thereby lowering the kinetic energy of the designated ions;

IV: in an isolation preparation phase of designated ions, exerting a radio frequency voltage for detecting ions on the ion trap gradually to form a corresponding radio frequency voltage when q is 0.8, the q being calculated according to the following formula:

$$q = \frac{8eV_{RF}}{m(r^2 + 2z^2)\Omega^2} = \frac{8V_{RF}}{(r^2 + 2z^2)\Omega^2} * \left(\frac{e}{m}\right) \quad (1)$$

where, $$\left(\frac{e}{m}\right)$$

is a cytoplasmic-nuclear ratio reciprocal of ions, $V_{RF}$ is a radio frequency voltage amplitude, Ω is a frequency value of a radio frequency voltage, r is a shortest distance value from a centre point of the ion trap to an electrode in an X direction or a Y direction, and z is a distance value from the centre point of the ion trap to an end cover in a Z direction;

V: in an isolation phase of designated ions, exerting a waveform on the electrode in the X direction of the ion trap, wherein the frequency of the waveform is frequency after the movement frequency of the designated ions in the X direction is eliminated within a range of 10 kHZ to 500 kHZ, so that other ions other than the designated ions are expelled from the ion trap to complete further separation on the designated ions and the other ions;

VI: in an isolation following phase of designated ions, reducing a radio frequency voltage on the ion trap gradually to a corresponding radio frequency voltage value when q is 0.25, and making preparations for following ions;

VII: in an ion fragmenting phase, setting a radio frequency voltage amplitude on the ion trap as a corresponding radio frequency voltage value when q is 0.25, setting a selective resonance alternating current voltage of the electrode in the X direction to be identical to the frequency of designated ions in the X direction so as to form resonance, and making the designated ions collide with buffer gas molecules so as to generate ion fragments and neutral lost molecules by breaking chemical bonds of the ions;

VIII: in an ion detection phase, increasing a radio frequency voltage amplitude gradually on the premise of remaining a radio frequency voltage frequency exerted on the ion trap unchanged, increasing an amplitude gradually on the premise of remaining a selective resonance alternating current voltage frequency of the X direction unchanged, when the radio frequency voltage rises to a corresponding radio frequency voltage value when q is less than 0.908 and greater than 0.2, moving fragmented ions with different cytoplasmic-nuclear ratios in the ion trap in the X direction in accordance with respective movement frequency, when the frequency of the fragmented ions is exactly identical to the alternating current voltage frequency exerted on the X direction, generating resonance, expelling the fragmented ions from the ion trap so as to be detected, and obtaining an ion fragment spectral dataset B for designated ions;

IX: in an ultraviolet light ionization chemical phase, when ion fragments are expelled within 10 ms behind the ion trap and some neutral gas molecules generated by fragmentation exist in the ion trap, opening a lamp front shutter, irradiating the neutral gas molecules in the ion trap by an ultraviolet lamp to ionize the neutral gas molecules, and capturing ions ionized by ultraviolet light by means of a radio frequency voltage on the ion trap until the ions are accumulated to a signal detectable degree;

X: in an ion detection phase, according to the operations in Step VIII, expelling the ions ionized by the ultraviolet light from the ion trap in accordance with a cytoplasmic-nuclear ratio, detecting the signal strength, and obtaining an ion spectral dataset C for ultraviolet light ionization of molecules in the ion trap; and XI: in a scanning stop phase, recovering each electrical parameter of the mass spectrometry apparatus and each vacuum interval of the multi-stage gradient vacuum system to an initial state.

* * * * *